US012677911B2

(12) United States Patent
Besl et al.

(10) Patent No.: US 12,677,911 B2
(45) Date of Patent: Jul. 14, 2026

(54) PROTECTIVE DEVICE FOR ATTACHING TO A SHOE

(71) Applicants: B & B GMBH, Grieskirchen (AT); Rupert Besl, Schmatzhausen (DE); Alexander Zangl, Etterzhausen (DE)

(72) Inventors: Rupert Besl, Schmatzhausen (DE); Alexander Zangl, Etterzhausen (DE); Wolfgang Berndorfer, Natternbach (AT)

( * ) Notice: Subject to any disclaimer, the term of this patent is extended or adjusted under 35 U.S.C. 154(b) by 0 days.

(21) Appl. No.: 18/691,952

(22) PCT Filed: Sep. 12, 2022

(86) PCT No.: PCT/EP2022/075263

§ 371 (c)(1),
(2) Date: Mar. 14, 2024

(87) PCT Pub. No.: WO2023/041478

PCT Pub. Date: Mar. 23, 2023

(65) Prior Publication Data

US 2024/0373986 A1 Nov. 14, 2024

(30) Foreign Application Priority Data

Sep. 15, 2021 (DE) ..... 10 2021 123 912.5

(51) Int. Cl.
*A43B 17/16* (2006.01)
*A43B 23/08* (2006.01)

(52) U.S. Cl.
CPC ..... *A43B 23/081* (2013.01); *A43B 17/16* (2013.01)

(58) Field of Classification Search
CPC ..... A43B 23/081; A43B 11/00; A43B 17/16; A43C 13/14; A61F 5/019
See application file for complete search history.

(56) References Cited

U.S. PATENT DOCUMENTS 3,407,518 A * 10/1968 Macquaid ..... A43C 13/14 36/72 R
5,926,978 A * 7/1999 Smith ..... A43B 3/24 36/138

(Continued)

FOREIGN PATENT DOCUMENTS

KR 20180093538 A 8/2018
WO 2005117630 A1 12/2005

OTHER PUBLICATIONS

International Search Report and Written Opinion in International Application No. PCT/EP2022/075263, mailed Dec. 12, 2022, 13 pages.

*Primary Examiner* — Jillian K Pierorazio
(74) *Attorney, Agent, or Firm* — Liang & Hennessey LLP; Brian Hennessey

(57) ABSTRACT

The invention relates to a protective device for attaching to a shoe, the shoe comprising a shoe sole and a front cap. The protective device includes a protective sole element and a protective cap element. The protective sole element can be placed on the shoe sole and has a sole shape which is adapted to the shape of the shoe sole, and the protective cap element can be placed against the front cap and has a cap shape which is adapted to the shape of the front cap. The protective sole element and the protective cap element are connected together via a joint, by which the front regions of the protective sole element and of the protective cap element are rotatably connected relative to each other and by which the protective device can be moved from a folded-out position into a folded-in position.

8 Claims, 4 Drawing Sheets

Protective device to fit onto a shoe

(56) References Cited

U.S. PATENT DOCUMENTS

| | | | | |
|---|---|---|---|---|
| 6,898,873 | B2 * | 5/2005 | Schenone | A43B 23/24 36/112 |
| 7,107,707 | B2 * | 9/2006 | Schenone | A43B 3/0078 36/100 |
| 7,134,225 | B2 * | 11/2006 | Ashton | A43B 11/00 36/94 |
| 7,681,332 | B2 * | 3/2010 | Allen | A43B 3/00 36/94 |
| 7,793,438 | B1 * | 9/2010 | Busse | A43B 11/02 36/105 |
| 8,943,713 | B1 * | 2/2015 | Eidson | A43B 21/00 36/136 |
| 9,044,060 | B2 * | 6/2015 | Delaney | A43B 3/242 |
| 2002/0059940 | A1 * | 5/2002 | Cain-Kozma | A45D 29/00 132/73 |
| 2008/0141565 | A1 | 6/2008 | Rini et al. | |
| 2013/0269213 | A1 * | 10/2013 | Gift | A43B 7/26 36/136 |
| 2015/0374094 | A1 * | 12/2015 | Gift | A43B 23/081 36/94 |
| 2019/0313730 | A1 * | 10/2019 | Reuben | A43B 7/06 |

* cited by examiner

Protective device to fit onto a shoe

PROTECTIVE DEVICE FOR ATTACHING TO A SHOE

CROSS-REFERENCE TO RELATED APPLICATIONS

The present application is a national phase application of PCT Application No. PCT/EP2022/075263, filed Sep. 12, 2022, entitled "PROTECTIVE DEVICE FOR ATTACHING TO A SHOE", which claims the benefit of European Patent Application No. 10 2021 123 912.5, filed Sep. 15, 2021, each of which is incorporated by reference in its entirety.

BACKGROUND OF THE INVENTION

1. Field of the Invention

The invention disclosed below relates to a protective device to fit onto a shoe according to the preamble of claim 1.

2. Description of the Related Art

Shoes which have a reinforced toecap are known in prior art. A reinforcement inserted into the toecap of the shoe in a fixed and thus non-removable manner is supposed to have the main technical effect of protecting the wearer's toes or forefoot as located underneath the toecap. In particular, the forefoot requires protection for being one of the wearer's body parts especially exposed to falling parts such as a hammer or other heavy items. There are regulations in labor law which require persons to wear such protective shoes in the workplace.

On the one hand, such shoes having a reinforced toecap provide good protection against hurting the forefoot due to falling parts. On the other hand, such shoes are not comfortable to wear. Although workers are encouraged to wear shoes with a reinforced toecap based on legal or other regulations, they often refuse to wear such shoes with a reinforced toecap on account of them not being comfortable enough.

SUMMARY OF THE INVENTION

The invention disclosed below has the object to provide an easy-to-wear protective device to protect a person's forefoot. The necessary comfort is to be achieved in part by the protective device being easy to attach.

The invention disclosed below relates to said protective device to fit onto a shoe.

The invention disclosed below also relates to the shoe having said removable protective device.

According to the invention, this is achieved in that the protective device comprises a protective sole element and a protective cap element, which protective sole element is attachable to the shoe sole and has a sole shape adapted to the shape of the shoe sole, which protective cap element is attachable to the toecap and has a cap shape adapted to the shape of the toecap, wherein the protective sole element and the protective cap element are connected via a joint, by which joint the front areas of the protective sole element and the protective cap element are rotatably connected, whereby the protective device is movable from a folded-out position into a folded-in position.

The inventive protective device protects the wearer's forefoot. Since the inventive protective device is preferably formed for temporary attachment to a shoe, the inventive protective device is initially characterized as such. In an equivalent manner, the protective device may also be used by attaching it to a sock, a boot or the like.

The inventive protective device comprises a protective sole element. The protective sole element has a shape such that the protective sole element is attachable with a surface on the outer side of the shoe sole. The surface has a shape congruent with the shape of the shoe sole.

The protective sole element may also encase the frame and the shoe sole, in particular the outsole of the shoe. The protective sole element covers at least that partial area of the outsole which contacts the ground beneath a shoe during walking.

The inventive protective device further comprises a protective cap element. The protective cap element has a shape such that the protective cap element covers at least partial areas of the outer side of the toecap. The shape of the protective cap element may be congruent with the shape of the toecap. A person of skill in the art will choose the partial area for encasement by the protective cap element such that the person's forefoot inside the shoe is sufficiently protected.

The skilled person will make the protective cap element out of a sufficiently rigid material such as, by way of example and not limitation, out of a metal like aluminium or a fiber-reinforced plastic. The skilled person will choose the material considering the deformation of the protective cap element as regulated by industry standards to achieve sufficient protection of the forefoot.

The protective sole element and the protective cap element are connected via a joint. The joint is arranged at the front end of the protective cap element and the protective sole element. In the protective device arranged on a shoe, the joint is arranged adjacent to the transition area between the front partial area of the toecap and the rear area of the sole. The joint is arranged in the area of the protective top. Since the protective cap element and the protective sole element each have shapes adapted to those of toecap and sole, respectively, encasing these parts of the shoe, the inventive device may also comprise a tip. The joint may be arranged adjacent to said tip.

The joint is arranged adjacent to that partial area of the shoe which undergoes no or only very little deformation, in particular stretching, during a common walking movement.

The joint may be executed as a movable joint defining the movement of the elements attached to said joint.

The elements may be releasably or unreleasably attached to the joint.

The joint may be a pivot joint or a sliding joint or a combination of pivot joint and sliding joint.

The joint may be executed as a joint which allows moving the attached parts without overcoming any resistance.

The joint may be a mechanical hinge. In the case of a mechanical hinge, rigid bodies are essentially moved towards one another. The size of a shoe is regulated by standards, considering the size of a foot. The inventive device may essentially have a size such that the protective device extends across a foot's toe area and ball area.

The inventive device may be charaterized by the joint comprising a joint axis which is arranged at a 90° angle to a longitudinal axis of the shoe.

The longitudinal axis of a shoe shall be defined as the axis which connects the center of the heel area and the center of the ball area. The longitudinal axis extends from the shoe tip to the rear end of the shoe.

The hinge axis extends at a 90° angle to the longitudinal axis and in or in parallel with the level of the shoe sole.

The joint may be executed as a deformable workpiece made, for example, of rubber. The deformable workpiece may be arranged on the inner side, i.e., on that side of the protective sole element and the protective cap element which faces the shoe. When moving the above elements towards one another, a deformable material arranged on the inner side of said elements will be biased, which counteracts said movement in the way of a resistance, thereby generating a force closing the above elements.

The joint may be made exclusively as a mechanical hinge or out of a deformable material.

The joint may be a combination of mechanical joint and deformable workpiece.

The inventive device may be charaterized by the device comprising a spring element, which spring element is biased in the folded-out position.

The biased spring element has a biasing force which causes the device to be transitioned into the folded-in position. During walking with a shoe having a protective device applied thereon, moving the ball area will achieve transitioning the protective device from the folded-in position into the folded-out position. The above elements of the protective device are moved around the joint relative to one another, wherein closing or folding-in of the elements is always achieved by biasing the spring element.

The inventive device may be characterized by the joint comprising the spring element.

In particular, the inventive device may be characterized by the spring element comprising a torsional spring.

The torsional spring may be biased when the elements attached to the joint are moved. The required force or energy applied in biasing the torsional spring may be a resisting force against moving the attached elements.

The inventive device may be characterized by the device comprising a locking element for releasably locking the protective sole element and the protective cap element in the folded-in position and/or in the folded-out position.

The locking element establishes a releasable mechanical connection between the protective sole element and the protective cap element. The force required to release said mechanical connection may be applied by walking with the shoe having the protective device applied thereon, whereby the front area of the shoe is deformed, and the shoe folded apart.

A person of skill in the art will be familiar with a plurality of releasable mechanical connections suitable for a such use. For example, the skilled person may provide engagement releasable by the above releasing force.

The locking element may be integrated into the joint.

The locking element may be arranged spaced apart from the joint as a releasable mechanical connection.

The inventive device may also be characterized by the locking element comprising friction surfaces which are contactable in the folded-in position or in the folded-out position.

A retaining force is achieved by contacting the friction surfaces, which retaining force releasably retains the elements in the respective position. Releasing this mechanical connection may be achieved by the retaining force mentioned above.

The inventive device may be characterized by the protective sole element being releasably connected to the shoe sole.

The inventive device may be characterized by the protective cap element being releasably connected to the toecap.

BRIEF DESCRIPTION OF THE DRAWINGS

The invention is additionally discussed based on the following embodiments represented in the Figures.

DETAILED DESCRIPTION

Figure 1:
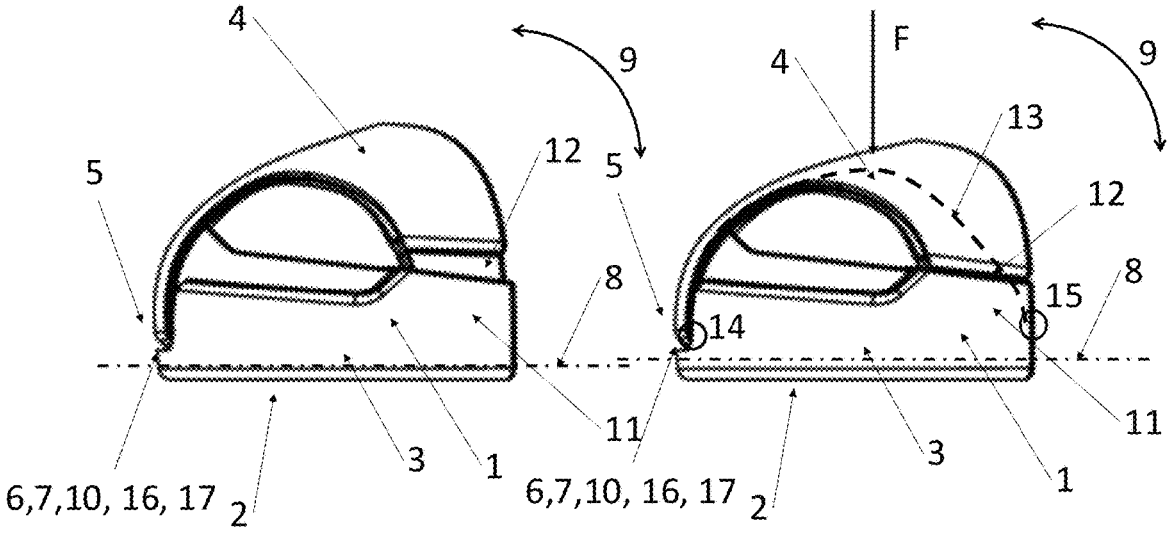
FIG. 1 shows side views of the device in the folded-in position (right side) and in a folded-out position (left side)

The embodiments shown in the Figures merely show potential embodiments, whereas it should be noted at this point that the invention is not limited to these specifically shown variant embodiments thereof but that combinations of individual variant embodiments among one another as well as a combination of one embodiment with the general description given above are also possible. Such further potential combinations do not require explicit mention, since said further potential combinations are within the knowledge of a person of skill in the relevant art based on the teachings on technical action in the context of the present invention.

The scope of protection is defined by the claims. The description and the drawings, however, are to be consulted in interpreting the claims. Individual features or combinations of features from the various embodiments shown and described may constitute autonomous inventive solutions. The object underlying such autonomous inventive solutions may be taken from the description.

In the Figures, the following elements are designated by the preceding reference numerals:

1 protective sole element
2 bottom face
3 lip
4 protective cap element
5 front area
6 joint
7 joint axis
8 shoe longitudinal axis
9 folding movement
10 spring element
11 first friction surface on protective sole element
12 second friction surface on protective cap element
13 static arc
14 bearing
15 bearing
16 lug
17 recess A potential embodiment of the inventive protective device is shown in different views and different positions in FIGS. 1 to 6.

Figure 7:
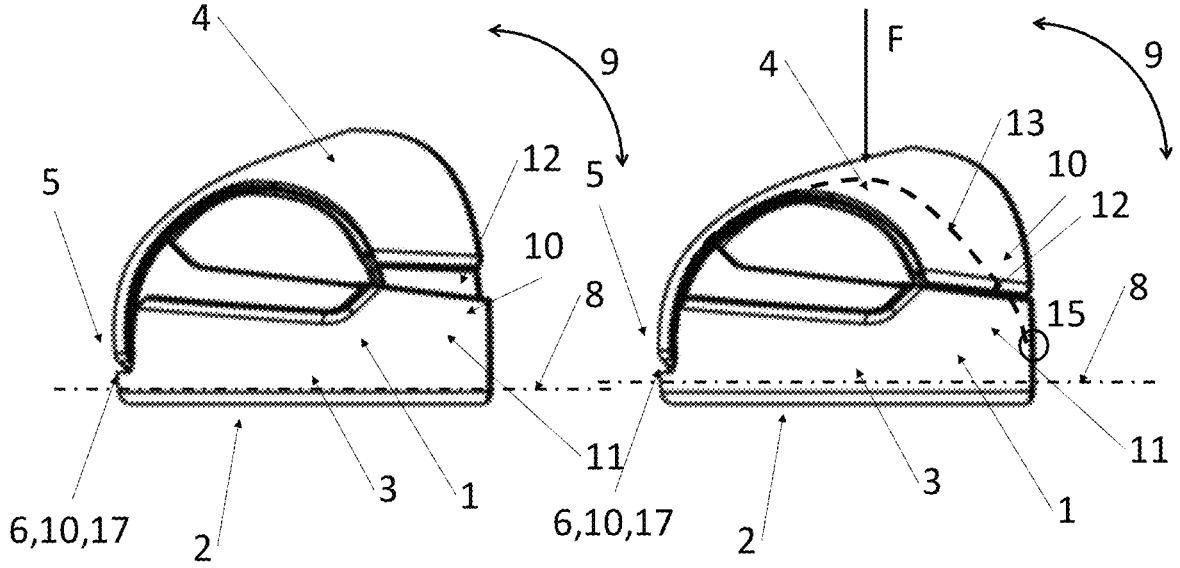
FIG. 7 shows another embodiment of the inventive protective device.

Another embodiment of the inventive protective device is shown in one view in FIG. 7.

A protective device to fit onto a shoe is shown, which shoe is itself not shown in FIGS. 1 to 7. Since the disclosure of the invention describes how to fit the described protective device onto the shoe, the combination of shoe and protective device is also disclosed by FIGS. 1 to 7. In the context of the disclosure of the inventive protective device it is contemplated that the inventive protective device may be fit onto a boot, a slipper or footwear in general.

The structure or parts of a shoe are known in prior art. For example, the parts of a shoe are discussed in the online encyclopaedia Wikipedia, as outlined in the introduction to this description. A shoe's structure requires no in-depth discussion in the context of the sufficient disclosure of the invention.

What is noteworthy for the invention is merely that a shoe has a toecap and a sole. A sole may consist of multiple partial soles, wherein the term 'sole' always means 'outsole' in the context of the disclosure.

The toecap is that area of the shoe which encases the toes and/or the forefoot of a person's foot at least in partial areas on its top. The toecap area may undergo at least partial deformation during walking. The inventive protective device is characterized by the protective device being able to respond to the deformation of the toecap.

The outsole is the area on the bottom of the shoe which contacts the ground beneath. The sole may undergo deformation at least in its front area during walking.

The design of the protective device disclosed herein is informed by the solution concept of allowing the above deformation of shoe sole and toecap during walking with a shoe having a protective device applied thereon, so that the user is inhibited by the protective device at as small an extent as possible.

The protective device may be formed out of a rigid material like metal (e.g., aluminium) or a fiber-reinforced plastic (e.g., carbon) to protect the foot. On the other hand, a sufficiently rigid formation of the protective device elements to protect the foot may be impedimental in walking. The invention attempts to solve this technical problem in the manner outlined in the context of the disclosure.

The protective device comprises a protective sole element 1. The protective sole element 1 is attachable to the shoe sole (not shown in FIGS. 1 to 6). The sole element 1 is attached on the bottom of the outsole. In its layout, the protective sole element 1 thus has a shape adapted to the shape of the outsole.

The protective sole element shown herein further has a special shape in which the sole element extends in a vertical direction around the vertical lip of the shoe sole or around the shoe frame. The protective sole element 1 thus encases the shoe sole and optionally the frame of the shoe.

The bottom 2 of the protective sole element 1 thus contacts the ground (not shown in FIG. 1) during walking with a shoe having an attached protective device. The protective sole element 1 made out of a rigid and non-pierceable or non-cuttable material thus provides protection from sharp or spiky objects on the ground. The protective sole element may comprise a deformable layer made, for example, of rubber on its bottom face, which bottom face may be contacted with an underground during walking. This increases the user's wearing comfort.

The protective sole element 1 discussed herein further has a special shape in which it extends across partial areas of the toecap. In its special shape, the protective sole element 1 has a vertical lip 3, which lip 3 extends across the frame of the shoe and/or across the toecap.

The protective device further comprises a protective cap element 4. The protective cap element 4 is attached to the toecap (not shown in FIGS. 1 to 6). The protective cap element 4 therefore has a curved shape adapted to the shape of the toecaps.

In the special shape of the embodiment as mentioned, the protective cap element 4 essentially extends across the top toecap area of the shoe. The bottom area of the toecap is essentially encased by the protective sole element 1. A person of skill in the art may choose to design this structure of encasing the toecap differently. For example, it may be possible for the protective sole element 1 to exclusively encase the shoe sole and for the protective cap element 4 to exclusively encase the toecap.

The protective cap element 4 and the protective sole element 1 are rotatably connected in their front area 5 by a mechanical joint 6. In the embodiment shown in FIGS. 1 to 6, the mechanical joint 6 is a special shape in that the mechanical joint 6 has a joint axis 7, which joint axis 7 is oriented at a 90° angle to the image plane of FIGS. 1 to 4 and in parallel with the image plane of FIG. 6. The joint axis 7 is further arranged at a 90° angle to the longitudinal axis 8 of the shoe. The longitudinal axis 8 essentially connects the central point of the ball area and the central point of the heel area or the respective elements to receive the shoe.

By the mechanical connection, which in FIGS. 1 to 6 is formed, for example, as a mechanical joint 6 having, again by way of example, a joint axis 7, the protective cap element 4 is adjustable with respect to the protective sole element 1. Said adjustability is defined by the mechanical connection and the degrees of freedom thereby defined.

The mechanical joint 6 with the joint axis 7 allows in particular a folding movement 9 of the protective cap element 4 with respect to the protective sole element 6. Said folding movement 9, which is shown in FIGS. 1 to 6 as an arcuate movement around the joint axis 7, resembles the deformation of the shoe in the front shoe area during walking. Wearing comfort is thereby achieved.

The protective sole element 1 and the protective cap element 4 may thus be brought into a folded-out position from a folded-in position by relative rotation around the joint axis 7 with respect to one another.

The inventive protective device may comprise a spring element 10, which spring element 10 is biased at least in the folded-out position. A person of skill in the art may size the spring element 10 such that said spring element 10 is biased due to the deformation of the shoe during walking and the folding movement 9 of the protective cap element 4 with respect to the protective sole element 1 thereby created. The spring element 10 must be sufficiently soft so that the spring element 10 does not generate pressure unpleasant to the person during walking.

The spring element 10 may have no bias in its folded-in position.

The spring element 10 may have bias in its folded-in position, whereby the protective cap element 4 is moved towards the protective sole element 1 by rotation around the mechanical joint 6, thereby allowing a clamping action on the shoe to be achieved. Due to the action of the spring element 10, the shoe, in particular the partial areas of the shoe encased by the inventive protective device, can be clamped in by the protective sole element 1 and the protective cap element 4, thereby allowing a releasable connection between the shoe and the inventive protective sole element to be achieved. Further possibilities of connecting the inventive protective device and the shoe are described below. A skilled person may combine or alternate them.

The embodiment shown in FIGS. 1 to 6 may be characterized by a special shape in which the spring element 10 is arranged in the mechanical joint 6. The mechanical joint 6 comprises the spring element 10. In a potential embodiment, the spring element 10 is formed as a torsional spring which can have its winding around the joint axis 7.

The inventive device may comprise a locking element by which the protective cap element 4 is releasably lockable in a position with respect to the protective sole element 1. The locking element may in particular cause releasable locking of the protective cap element 4 with respect to the protective sole element 1 in the folded-in position or in the folded-out position.

In the embodiment of the inventive protective device shown in FIGS. 1 to 6, the optional locking element is formed by a first friction surface 11 and a second friction surface 12. The first friction surface 11 is formed by the protective sole element 1, here, for example, by the vertical lip 3. The second friction surface 12 is formed the protective cap element 4, here also by a vertical lip.

The first friction surface 11 and the second friction surface 12 contact one another at least in the folded-in position of the inventive protective device. The relative movement 9 of the friction surfaces 11, 12 with respect to one another is dictated by the joint 6. It is also achieved through the joint 6 that the friction surfaces 11, 12 contact one another during their relative movement 9.

The first friction surface, which is formed by the protective sole element 1, may be arranged outside of the second friction surface 12.

A force F acting on the protective cap element 4 from above always causes downwards deformation of the protective cap element 4. Statically speaking, the protective cap element 4 acts as an arc on two bearings, which arc is essentially under bending load.

The force 4 may, for example, symbolize a hammer falling on a person's foot, which would cause injuries to the person's foot. It is an object of the invention to protect the person against such injury. To achieve this, industry standards require maximum deflexion of the protective cap element 4 given a force F acting on the protective cap element 4.

In transferring the acting force F, the protective cap element 4 statically speaking acts as an arc essentially under bending load. The external arrangement of the lip 3 with the first friction surfaces 11 causes the horizontal forces H acting between the bearings 14, 15 to be received by the protective sole element 1. Since the protective sole element 1 prevents lateral displacement of the bearings 14, 15, deformation of the static arc 13 and thus of the protective cap element 4 is prevented or at least kept within an area conforming to standards. This further allows easy execution of the protective cap element 4. Reference shall be made in this context to FIG. 5, in which the arc 13 is shown in a rear view.

Statically speaking, the protective cap element 4 also acts as an arc in the side view (see FIG. 1). Preferably, the joint 6 is formed such that it can receive horizontal forces H from the protective cap element 4 under load by a force F.

Figure 2:
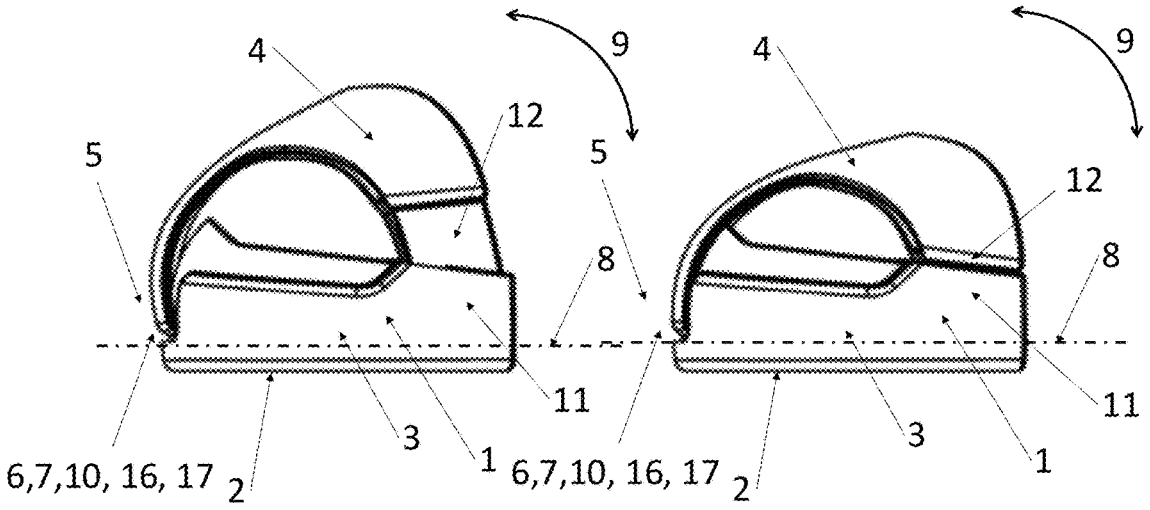
FIG. 2 shows side views of the device in the folded-in position (right side) and in another folded-out position (left side)

The right sides of FIG. 1 and FIG. 2 show the inventive protective device in a folded-in position. In comparison, the left side of FIG. 2 shows the protective device in the folded-out position. The left side of FIG. 1 shows the protective device in an intermediate position.

Figure 3:
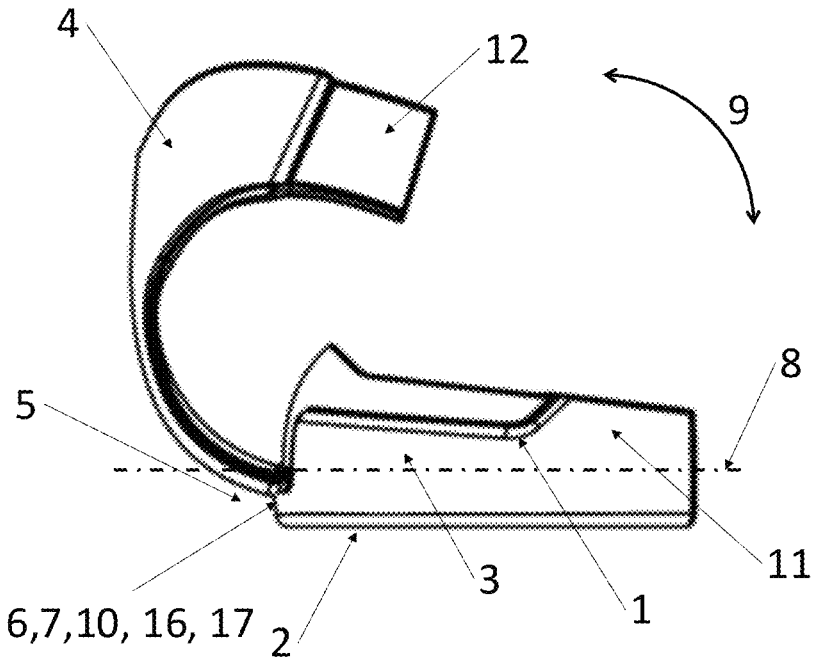
FIG. 3 shows a side view of the device in a folded-out position.

FIG. 3 shows the protective device in a position in which the protective device can easily be attached to a shoe.

Figure 4:
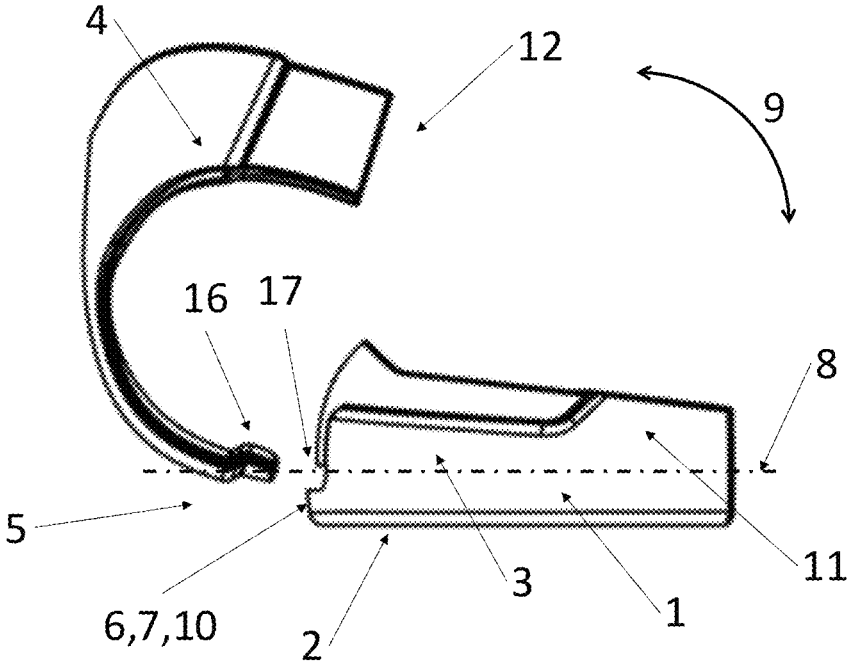
FIG. 4 shows a side view of the device in a folded-out position with the protective sole element and the protective cap element separated.

FIG. 4 shows the protective device in a position in which the protective device is disassembled. The joint 6 may comprise plugging element, so that the protective sole element 1 can be separated from the protective cap element 4.

Figure 5:
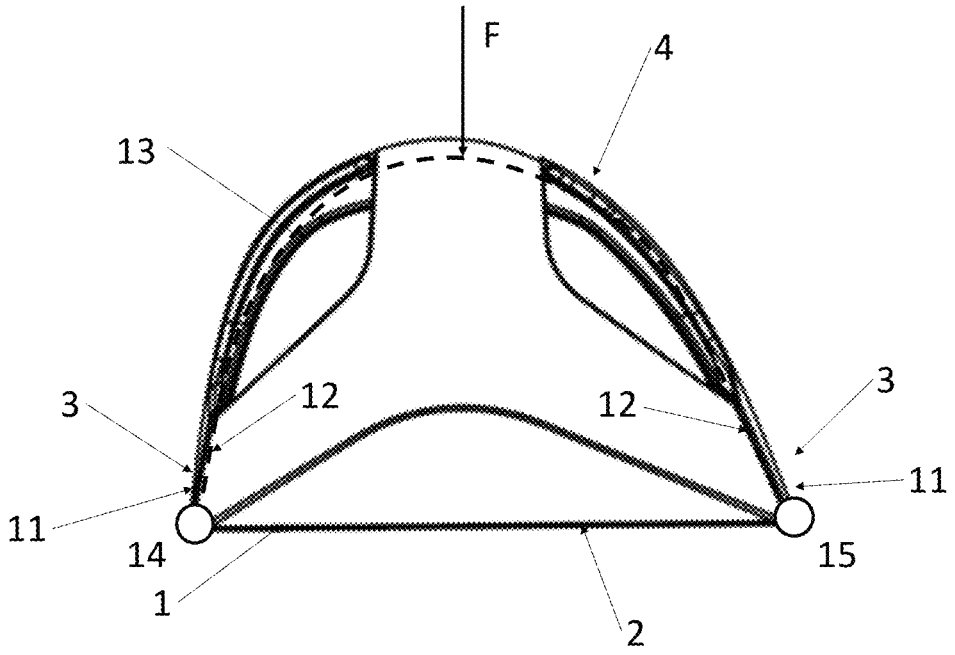
FIG. 5 shows a rear view of the device.

FIG. 5 shows the protective device in a rear view.

Figure 6:
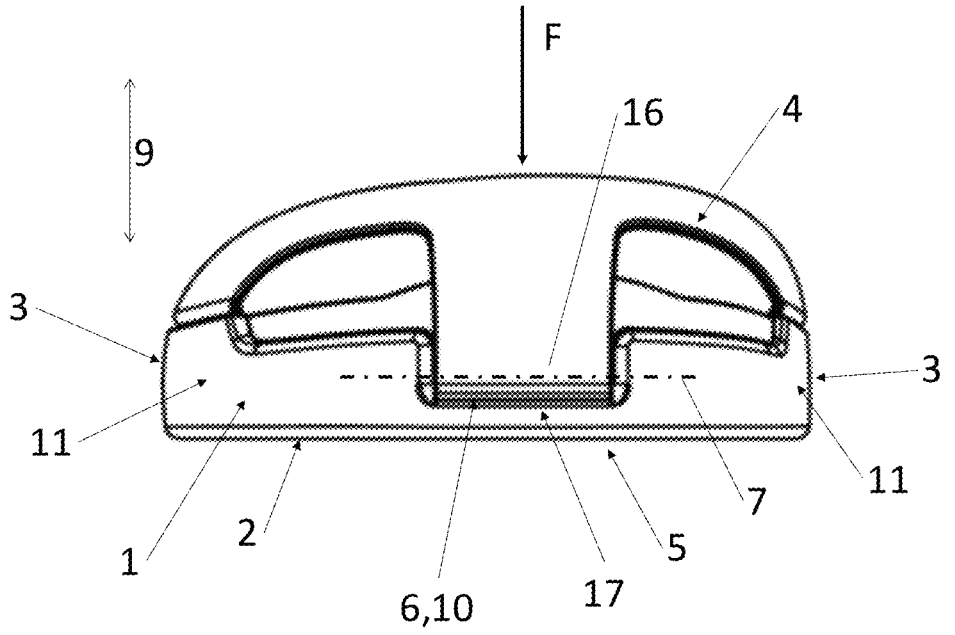
FIG. 6 shows a front view of the device.

FIG. 6 shows the protective device in a front view.

It is mentioned in the above description that the inventive protective device can be clamped onto the outer side of the shoe. The required clamping force is applied by the spring element 10, while the protective sole element 1 and the protective cap element 4 are pushed to the outer surface of the shoe by being folded together around the joint 6.

Additionally or alternatively to releasably fastening the protective device 1 to the shoe as mentioned above, the protective sole element 1 may be fastened to the shoe sole via a releasably mechanical connection such as, by way of example and not limitation, via screwing, engagement. Preferably, the mechanical connection, such as the engagement, for example, allows fastening the protective sole element 1 to the shoe sole while applying essentially vertical pressure.

Further additionally or alternatively to releasably fastening the protective device to the shoe as mentioned above, the protective cap element 4 can be connected to the toecap via a releasable mechanical connection.

It is mentioned in the above description that the protective device is releasably fastenable to the shoe. The invention is by no means limited to releasable fastening. Fastening the protective device to the shoe may also be formed to be non-releasable and thus rigid. The protective device may also be embedded between layers of the toecaps and layers of the shoe sole.

A shoe may comprise a device for closing the shoe such as shoelace, Velcro® tape, for example. The protective device may be fastened to the shoe via said device for closing the shoe. When using the shoelace to fasten the protective device to the shoe, the protective device may have holes through which the user can guide the shoelace.

At least partial areas of the inventive protective device may be made out of an elastically deformable material. The protective sole element 1 and/or the protective cap element 4 may be attached to the shoe under the elastic deformation and biasing thereof. The biasing causes a releasable mechanical connection between the shoe and the inventive protective device.

The exemplary formation of the inventive protective device out of plastic, in particular fiber-reinforced plastic, is mentioned above. Partial areas of the protective device may be made out of an elastic plastic.

The protective sole element 1 with the lip 3 may also be formed as a shape encasing partial areas of the shoe, so that the protective sole element 1 is attachable to the shoe under the deformation of partial areas of the shoe. This releasable mechanical fastening is particularly suitable for shoes with a shoe sole made of rubber, a material like PU, TPE or India rubber.

The protective sole element 1 may also have recesses for receiving tread bars of the shoe in its partial area forming the bottom 3. A releasable mechanical connection between the shoe and the protective sole element 1 may be established by inserting and deforming the tread bars.

FIG. 4 shows a potential shape of the joint 6, which joint 6 is itself shown in a disassembled position. The joint 6 comprises a lug 16 formed by the protective cap element 4, which lug 16 is introduced in a recess 17 (see FIG. 6) when assembling protective cap element 4 and protective sole element 1. A skilled person will be familiar with such joints including lug and recess.

The lug 16 and the recess 17 may be formed such that moving, and in particular folding apart, the protective sole element 1 and the protective cap element 4 causes deformation of the lug 16 and/or recess 17. When forming at least the lug 16 and/or the recess 17 out of an elastic material, a spring effect may thus be achieved. For example, the lug 16 and/or the recess 17 may act as spring element 10 and as joint 6.

The protective device may have recesses 17 in the protective sole element 1 and in the protective cap element 4. The recesses 17 may be arranged in areas in which the shoe has a further deformation, which further deformation cannot be responded to by the folding movement 9 of the inventive protective device.

FIG. 7 shows a further embodiment of the inventive device.

Said further embodiment relates, equally to the embodiment described above, to a protective device to fit onto a shoe. While a shoe is not shown in FIG. 7, the combination of the shoe with the protective device is also disclosed by the discussion below.

FIG. 7 shows a further embodiment of a protective device to fit onto a shoe, which shoe comprises a shoe sole and a toecap according to the current teaching.

The protective device comprises a protective sole element 1 and a protective cap element 4, which protective sole element 1 is attachable to the shoe sole and has a sole shape adapted to the shape of the shoe sole, which protective cap element 4 is attachable to the toecap and has a cap shape adapted to the shape of the toecap, wherein the protective sole element 1 and the protective cap element 4 are connected via a joint 6 formed by a deformable workpiece, by which joint 6 the front areas 5 of the protective sole element 1 and the protective cap element 4 are rotatably connected, by which joint 6 the protective device is movable from a folded-out position into a folded-in position.

The further embodiment shown in FIG. 7 thus differs from the embodiment shown in FIGS. 1 to 6 by the formation of the joint.

The device shown in FIG. 7 is characterized by the joint 6 being made out of a deformable workpiece. For example, the joint 6 may be made out of an elastic material such as a rubber.

The device may further be characterized by the device comprising a spring element 10, which spring element 10 is biased in the folded-out position. The joint 6 and the spring element may be formed out of the same material.

The device shown in FIG. 7 may be characterized by the device comprising a locking element for releasably locking the protective sole element 1 and the protective cap element 4 in the folded-in position and/or in the folded-out position. The locking element may comprise friction surfaces 11, 12, which friction surfaces 11, 12 are contactable in the folded-in position or in the folded-out position.

Whereas the spring element is arranged exclusively in the area of the joint 6 in the device shown in FIGS. 1 to 6, the spring element is arranged in the area of the joint 6 and additionally in the rear area, the area of the locking element, in the device shown in FIG. 7.

The invention claimed is:

1. A protective device to fit onto a shoe, the shoe including a shoe sole and a toecap, the protective device comprising:

a protective sole element attachable to the shoe sole and having a sole shape adapted to a first shape of the shoe sole; and a protective cap element attachable to the toecap and having a cap shape adapted to a second shape of the toecap;

wherein the protective sole element and the protective cap element are connected via a joint, the joint rotatably connecting a first front area of the protective sole element and a second front area of the protective cap element;

wherein the protective device is movable via the joint from a folded-out position into a folded-in position;

wherein the protective device comprises a torsional spring element, the torsional spring element being biased in the folded-out position;

wherein the joint comprises the torsional spring element; and wherein the protective cap element is releasably attached to an outer surface of the toecap.

2. The protective device of claim 1, wherein the joint is formed as a mechanical joint.

3. The protective device of claim 2, wherein the mechanical joint comprises a joint axis arranged at a 90° angle to a longitudinal axis of the shoe.

4. The protective device of claim 1, wherein the joint is composed of a deformable workpiece.

5. The protective device of claim 1, wherein the protective device comprises a locking element for releasably locking the protective sole element and the protective cap element in at least one of the folded-in position and the folded-out position.

6. The protective device of claim 5, wherein the locking element comprises friction surfaces, the friction surfaces being contactable in at least one of the folded-in position and the folded-out position.

7. The protective device of claim 1, wherein the protective sole element is releasably connected to the shoe sole.

8. The protective device of claim 1, wherein the joint is arranged on a first front edge of the first front area and a second front edge of the second front area.

* * * * *